United States Patent [19]

Murray et al.

[11] 4,380,296

[45] Apr. 19, 1983

[54] YARN HOLDER AND METHOD OF SEPARATING YARN BY COLOR

[76] Inventors: James F. Murray; Geneva A. Murray, both of 4808 Sipple Ave., Baltimore, Md. 21206

[21] Appl. No.: 225,732

[22] Filed: Jan. 16, 1981

[51] Int. Cl.[3] ..... B07C 7/04; B65D 85/00

[52] U.S. Cl. ..... 209/704; 211/10; 211/61; 211/70; 206/388

[58] Field of Search ..... 209/614, 942, 702, 703, 209/704; 211/61, 70, 10, 60 R; 223/DIG. 1, 106, DIG. 2, 97; 206/388; 289/16.5

[56] References Cited

U.S. PATENT DOCUMENTS

| | | | |
|---|---|---|---|
| 594,519 | 11/1897 | Bristow . | |
| 613,324 | 11/1898 | Selcer . | |
| 929,897 | 8/1909 | Taylor | 211/70 |
| 978,670 | 12/1910 | Solomon . | |
| 1,221,517 | 4/1917 | Dunbar | 211/70 |
| 1,757,600 | 5/1930 | Sprowle | 294/143 X |
| 1,888,324 | 11/1932 | Matthai | 294/143 |
| 2,827,247 | 3/1956 | Kraemer . | |
| 2,968,407 | 1/1961 | Dresser | 211/61 |
| 3,077,985 | 2/1963 | Anderson | 209/704 |
| 3,472,389 | 10/1969 | Lowe | 211/60 R |
| 3,856,140 | 12/1974 | Fitts . | |
| 3,949,452 | 4/1976 | Henderson | 206/388 X |
| 4,008,806 | 2/1977 | Paez | 206/388 X |

*Primary Examiner*—Allen N. Knowles

*Attorney, Agent, or Firm*—Schwartz, Jeffery, Schwaab, Mack, Blumenthal & Koch

[57] ABSTRACT

The invention comprises a circular, transparent, plastic disc having a plurality of circular holes located equidistant from the center of the disc and being substantially equidistant from each other. A plurality of radial tabs equal in number to the number of holes and located on radii corresponding to respective holes provides a device wherein a plurality of strands of yarn are cut into substantially equal lengths and divided by color. The yarn of like color is inserted through a hole, and a central portion of the yarn is pulled over a tab corresponding with the hole on its radius, thus locking the strands in place relative to each other and the disc. The disc can be mounted on posts extending from a "lazy-Susan" base.

7 Claims, 3 Drawing Figures

YARN HOLDER AND METHOD OF SEPARATING YARN BY COLOR

BACKGROUND OF THE INVENTION

1. Field of the Invention

The invention relates to a yarn holder, and particularly a yarn holder for dividing and securing yarn which has been separated by color, as well as the method of doing same.

2. Prior Art

Various devices have been provided in the past for holding skeins of yarn wherein the yarn may be separated by colors. Such prior art devices are exemplified by U.S. Pat. Nos. 594,519, 613,324, 2,827,247 and 3,856,140. The first three patents all include means for securing the yarn in enclosed type containers; whereas, the latter patent illustrates a palette of transparent material and having a series of holes through which individual strands of yarn are extended and then reverted back to an enlarged slot wherein they are held collectively. This latter U.S. Pat. No. 3,856,140 has the obvious disadvantage of requiring the user to hold the yarn at all times or risk having the yarn fall off and/or become entangled with adjacent pieces.

OBJECTS AND SUMMARY OF THE INVENTION

It is an object of the instant invention to provide a yarn holder which easily maintains the yarn in predetermined locations and divided from other yarn in the group.

Another object is to provide a yarn holder which can be easily manipulated to provide access to the desired yarn of a given color and of a preselected length.

Still another object is to enable the user to pull out individual threads of yarn without entangling or jamming either the hank or interfering with the other hanks of yarn.

The invention comprises a circular, transparent, plastic disc having a plurality of circular holes located equidistant from the center of the disc and being substantially equidistant from each other. A plurality of radial tabs equal in number to the number of holes and located on radii corresponding to respective holes provides a device wherein a plurality of strands of yarn are cut into substantially equal lengths and divided by color. The yarn of like color is inserted through a hole, and a central portion of the yarn is pulled over a tab corresponding with the hole on its radius, thus locking the strands in place relative to each other and the disc. The disc can be mounted on posts extending from a "lazy-Susan" base.

BRIEF DESCRIPTION OF THE DRAWINGS

The above and other objects of the invention will become more readily apparent from the following description and accompanying drawings wherein.

DETAILED DESCRIPTION OF THE INVENTION

Figure 1:
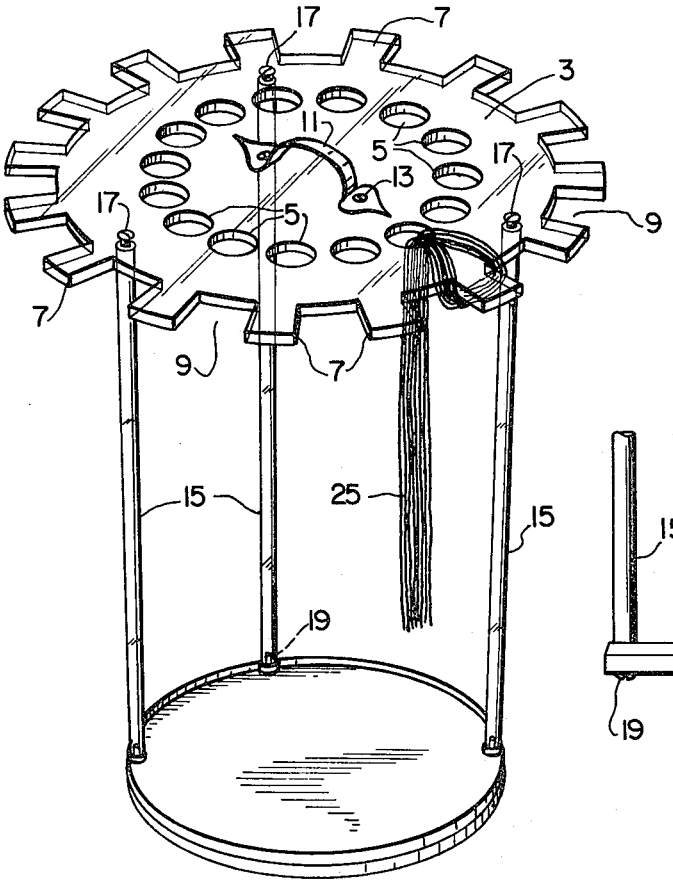
FIG. 1 is a perspective view of one embodiment of the invention.
Figure 3:
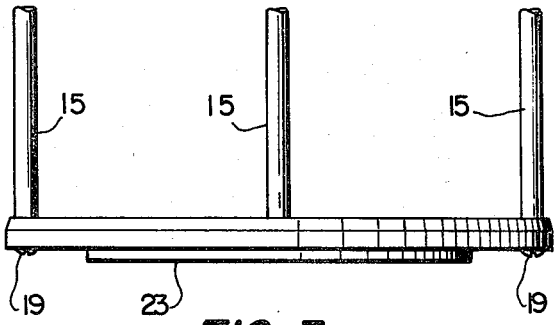
FIG. 3 is a side elevation view of the lower portion of the invention as viewed from FIG. 1.

A yarn holder is seen at 1 in FIG. 1 and includes a generally planar, transparent, plastic disc 3 which has a plurality of circular holes 5 located substantially equidistant from the center of the disc 3. On substantially the same radius as the holes 5 are a corresponding number of radially extending tabs or tongues 7 separated by grooves 9. A handle 11 is attached by means of nuts and bolts, rivets or other similar means 13 to the disc 3.

Attached to the disc 3 are a plurality of upstanding plastic or other type posts 15 which are secured by means of a corresponding number of pins 17. The posts 15 are secured by means of a plurality of screws or the like 19 to a base 21. The base 21 rotates in a "lazy-Susan" manner on a lower base 23, all in a conventional manner.

Figure 2:
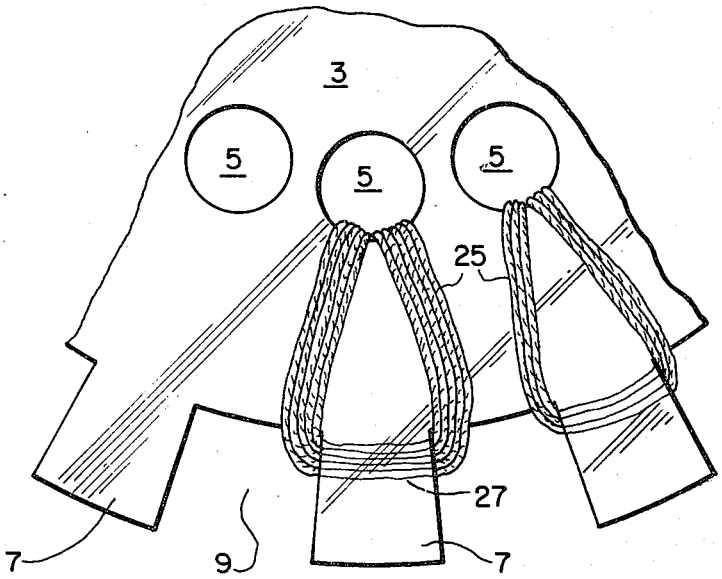
FIG. 2 is a fragmentary, top view of a portion of the invention seen in FIG. 1.

A plurality of strands of yarn 25 are cut of substantially equal lengths. The several strands of yarn are held below the holes 5 with their central end portion 27 adjacent a hole 5. By means of a hook or by using a finger or otherwise pushing or pulling the yarn end 27 up through the opening 5, the central portion of the yarn 27 is separated, wrapped and locked around a tab 7 as seen in FIGS. 1 and 2. It will be appreciated that the yarn is divided by colors whereby a different color extends up through an opening 5 and over a corresponding tab-lock 7. When it is desired to use a particular colored strand, the user merely separates one of the strands 25 at 27 from the tab-lock 7. The selected strand is then pulled up through the hole 5 and out from the remaining strands of the same color.

While one embodiment of the invention has been described, it will be understood that it is capable of further modifications and this application is intended to cover any variations, uses, or adaptations of the invention, following in general the principles of the invention and including such departures from the present discosure as to come within knowledge or customary practice in the art to which the invention pertains, and as may be applied to the essential features hereinbefore set forth and falling within the scope of the invention or the limits of the appended claims.

What is claimed is:

1. A yarn holder comprising:

(a) a substantially circular disc, (b) a plurality of substantially circular holes formed in said disc, each of said holes being located substantially on a radius and being substantially equidistant from each other, (c) a plurality of substantially radial tabs, equal in number to the holes located substantially on radii adjacent to respective holes, and (d) a plurality of elongated posts having one end thereof secured to the bottom of said disc, and a base secured to the other ends of said posts.

2. A yarn holder as defined in claim 1 including a handle secured to said disc at substantially the center thereof.

3. A yarn holder as defined in claim 1 wherein said disc is transparent plastic.

4. A yarn holder as defined in claim 1 including a rotating "lazy-Susan" lower base member connected to the bottom of said base, whereby said base and disc rotate relative to said lower base.

5. A method of separation and retaining yarn and the like comprising:

(a) providing a disc with a plurality of holes therein, (b) forming a plurality of tabs on said disc and extending from the edge thereof, each tab corresponding to a respective hole, (c) cutting a plurality of strands of yarn into substantially equal lengths and dividing the strands of yarn by color, (d) inserting a plurality of strands of like-color yarn through a hole, and pulling the central portion of the yarn in each strand over a corresponding tab, the locking the strands in place relative to each other and the disc.

6. The method of claim 5 including attaching said disc to a base separated therefrom.

7. The method of claim 6 including providing means on said base for rotating the disc relative to a support surface.

* * * * *